United States Patent [19]

Calamani et al.

[11] 4,013,238

[45] Mar. 22, 1977

[54] DEVICE FOR CONTROLLING THE BALLOON AND TENSION IN THE THREAD FROM A THREAD STORING AND DISTRIBUTING APPARATUS TO AN OPERATING MACHINE

[76] Inventors: Sergio Calamani, Via Settima 27, Segrate San Felice (Milan); Eugenio Turri, Via Benedetto Marcello 1; Ermanno Savio, Via Garofalo 29, both of Milan, all of Italy

[22] Filed: Oct. 20, 1975

[21] Appl. No.: 624,162

[30] Foreign Application Priority Data

Oct. 21, 1974 Italy ..... 28631/74

[52] U.S. Cl. ..... 242/47.01; 242/47.12

[51] Int. Cl.[2] ..... B65H 51/02

[58] Field of Search ..... 242/47.01, 47.08, 47.09, 242/47.1, 47.11, 47.12, 47.13, 47.04, 47.05, 128, 147 R; 66/132 R; 57/58.86, 58.87

[56] References Cited

UNITED STATES PATENTS

| | | | |
|---|---|---|---|
| 2,128,487 | 8/1938 | Klein | 242/128 |
| 2,479,826 | 8/1949 | Frick et al. | 242/128 |
| 2,662,364 | 12/1953 | Kingsbury | 57/58.86 |
| 3,202,380 | 8/1965 | Hosbein | 242/128 |
| 3,425,647 | 2/1969 | Kovaleski et al. | 242/128 |
| 3,672,590 | 6/1972 | Rosen | 242/47.12 |
| 3,702,176 | 11/1972 | Rosen | 242/47.01 |
| 3,782,661 | 1/1974 | Deniega et al. | 242/47.12 |
| 3,834,635 | 9/1974 | Pfarrwaller | 242/47.01 |

*Primary Examiner*—John Petrakes
*Attorney, Agent, or Firm*—Haseltine, Lake & Waters

[57] ABSTRACT

Device for controlling the balloon and tension in the thread from a thread storing and distributing apparatus to textile machines. Such a device comprises a bell superimposed to the storing apparatus and supported thereon by flexible fingers which are deflected by the thread unwinding from the apparatus.

5 Claims, 1 Drawing Figure

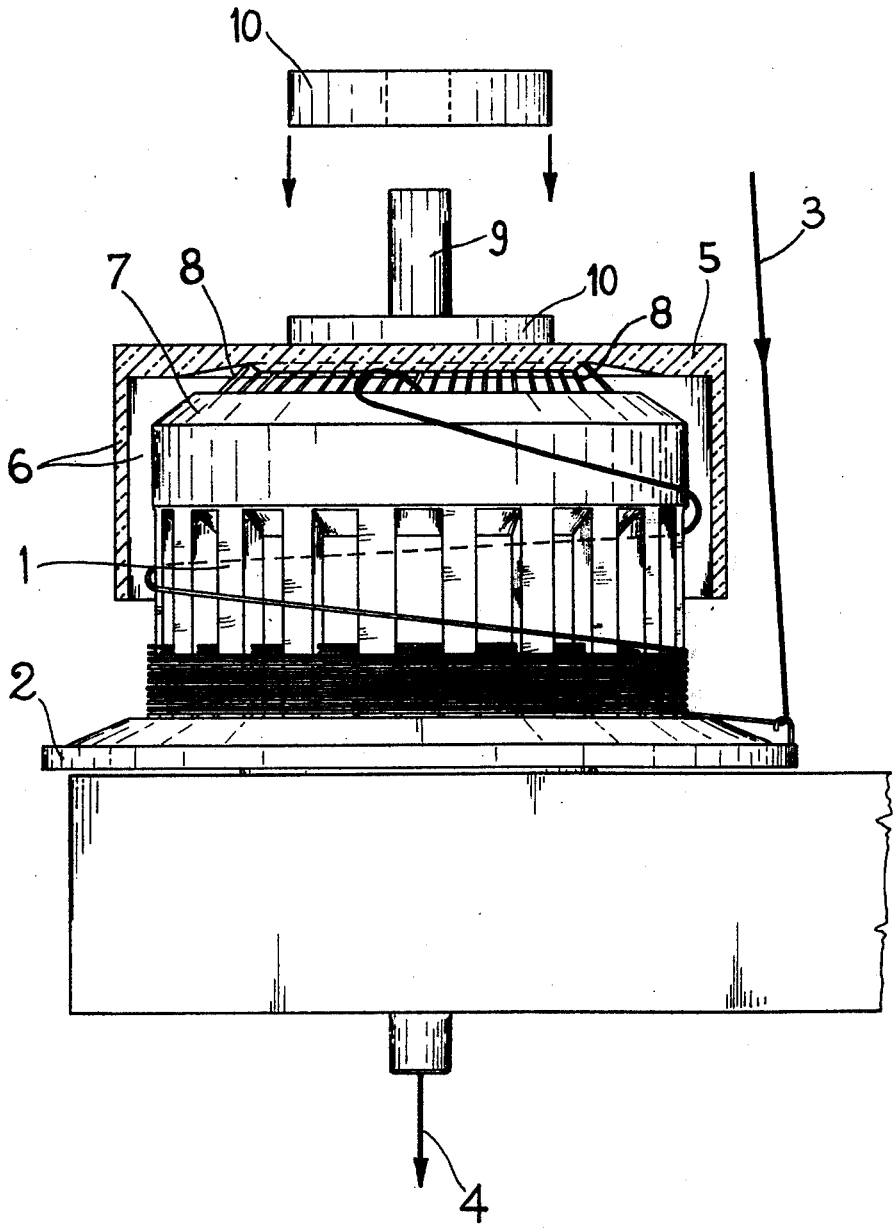
10
9
10
8
7
8
5
3
6
1
2
4

DEVICE FOR CONTROLLING THE BALLOON AND TENSION IN THE THREAD FROM A THREAD STORING AND DISTRIBUTING APPARATUS TO AN OPERATING MACHINE

BACKGROUND OF THE INVENTION

This invention relates to a device for controlling the balloon and tension in the thread from a storing and distributing apparatus to an operating machine.

As is well known in the art, many operating machines, such as weaving machines, are not directly supplied with yarn from a bobbin, cop or the like, but such a yarn from the bobbin reaches the operating machine after being previously wound on an apparatus, where a magazine or supply yarn is formed. The yarn is then supplied to utilization with constant controlled tension.

One being drawn from these storing apparatus, the yarn unwinds at a very high speed at the periphery of a drum, on which it is wound in turns. Many types of devices have been proposed for imparting a predetermined rate of tension to the yarn unwinding from the drum. However, it was found that, although being effective in imparting a predetermined rate of tension to the yarn unwinding from the drum, these devices are not versatile. Thus, they do not allow adjusting the tension to rates that vary with time.

Furthermore, the risk very often occurs that the thread unwinding from the drum would form balloons due to centrifugal force, or would tend to be moved away from the drum to a high extent, thus preventing any control of outlet speed and yarn tension.

It is the primary object of the present invention to provide a device of simple structure and low cost of production, which is readily applicable to known type of thread storing apparatus. The device is to enable controlling the balloon of the thread unwinding from the apparatus to which such a device is applied, and also to enable controlling the tension of the yarn supplied to an operating machine at a constant rate and extent that can be easily and readily varied.

SUMMARY OF THE INVENTION

These and other objects are accomplished by a device comprising a bell having a base wall, from which a substantially cylindrical peripheral wall extends. The bell has an inner diameter larger than the outer diameter of the storing apparatus to which the device is applicable. An element is provided for supporting and spacing the base wall on the top of a yarn storing apparatus. The element comprises a plurality of thin elongated flexible fingers having a free end thereof. The flexible fingers are inclined in the yarn movement direction during the unwinding of the storing apparatus and are distributed according to a circular crown or sector.

BRIEF DESCRIPTION OF THE DRAWING

In order that the structures and features of the device be more clearly understood, a preferred embodiment thereof will now be described, as given by mere way of example, reference being had to the accompanying DRAWING, in which the single FIGURE shows the device mounted on a yarn storing apparatus.

DESCRIPTION OF THE PREFERRED EMBODIMENTS

In a front elevational view, the FIGURE of the drawing shows a yarn storing and distributing apparatus comprising a cylindrical drum 1, on which a rotating distributor 2 forms a number of turns by means of a yarn 3 arriving, for example, from a bobbin or cop. In a conventional manner, these turns are upward axially displaced along drum 1. Yarn 4, which is supplied to the operating machine (for example a textile machine), passes through a hole provided along the axis of drum 1 and unwinds from the top of the drum, as clearly shown in the FIGURE of the drawing. During this unwinding step of the yarn from the drum, the yarn fastly rotates all about the drum, while moving at the same time from the periphery of the center of the drum.

As mentioned above, many types of these apparatus are known and are extensively used in the art and therefore will not be herein described in detail. For example, some embodiments of these apparatus are described in U.S. Pat. No. 3,796,386, while another embodiment is described in the U.S. Pat. Application No. 565,607 filed on Apr. 7, 1975, by the same applicants of this invention.

The device according to the present invention comprises a bell, outlined in the drawing, and having a base wall 5, from which a cylindrical peripheral wall 6 extends with inner diameter larger than the outer diameter of drum 1, to which the device is applied. In addition to the bell, the device comprises a base 7 bearing at the top of drum. From this base a plurality of thin flexible elongated fingers 8 extend upwardly, the upper ends of which are free. The fingers are distributed according to a circular crown or sector coaxial with drum 1. These fingers, for example, are made of plastics material, and are inclined in the thread movement direction. They are preferably inclined both in the direction of rotation for the thread about the upper end of the drum during the unwinding step, and are slightly inclined to the center.

An important feature of the above described device is that the base wall 5, that is the whole bell, simply rests on the free ends of the fingers 8, so that as the yarn is unwound from drum 1, the yarn passes between the upper ends of fingers 8 and the underside of base wall 5. As apparent, the yarn will cause the deflection of these fingers one at a time, so that the braking action exerted by the fingers on the yarn will be substantially due only to the action, or pressure, of one of these fingers at a time.

The combined action of fingers 8 and base wall 5 is that of controlling the tension in the thread unwinding from drum 1. The cylindrical wall 6 accomplishes the function of controlling the balloon tending to be formed by the unwinding yarn due to centrifugal effect, and presents such a balloon from taking undue and no longer controllable dimensions.

As it will be seen from the FIGURE of the drawing, a pin 9 projects from the upper surface of base wall 5. The pin in this case may be hollow for allowing the yarn unwound from the drum to exit therethrough. The pin is exactly positioned at the center of the base wall 5 and on which rings 10 of an exactly predetermined weight can be slipped.

Evidently, should only one ring 10 weigh on the bell, such a weight will be distributed on fingers 8. These will exert a predetermined pressure on the surface of wall 5, and accordingly will cause a predetermined braking action on the drum unwinding thread. If two or more rings weigh on or rest on the bell, the braking action to be exerted by flexible fingers 8 on the unwinding yarn can be very simply and exactly adjusted to a predetermined rate.

Finally, it should be noted that the underside of wall 5 can be easily shaped so that fingers 8 by acting on the surface will assure the bell centering on drum 1.

As apparent, instead of being fast with and projecting from a base 7, the fingers 8 can be fast with and project from from the underside of wall 5 or project from the cylindrical peripheral wall 6. In such cases, the flexible fingers would have the free ends thereof bearing on the upper surface of drum 1.

The device described has been proven to be perfectly efficient in assuring a correct control of tension and elimination of balloons when unwinding all types of yarn, elastomer yarns excluded.

What we claim is:

1. A device for controlling the balloon of the tension in a thread from a thread storing and distributing apparatus to an operating machine, said device comprising: a bell having a base wall; a substantially cylindrical peripheral wall extending from said base wall; said bell having an inner diameter larger than the outer diameter of storing apparatus to which the device is applicable; means for supporting and spacing said base wall on the top of a yarn storing apparatus; said means comprising a plurality of thin flexible elongated fingers having one free end, said flexible fingers being inclined to the yarn movement direction during the unwinding step of the storing apparatus and being distributed according to a circular crown or sector, said bell being supported directly and safely by said fingers.

2. A device according to claim 1, wherein said thin flexible fingers are inclined to the center of said base wall.

3. A device according to claim 1, wherein said thin flexible fingers are fast with a rigid element directly restable on the top of a yarn storing apparatus.

4. A device according to claim 1, including a shaped element projecting from the upper surface of said base wall for accommodating and holding weights applicable to said bell for causing the yarn being unwound from the apparatus to acquire tension of a predetermined rate.

5. A device as defined in claim 1 including a shaped element projecting from the upper surface of said base wall for accommodating and holding weights applicable to said bell for causing the yarn being unwound from the apparatus to acquire tension of a predetermined rate; said thin flexible fingers being inclined to the center of said base wall; said thin flexible fingers being fast with a rigid element directly restable on the top of a yarn storing apparatus.

* * * * *